US011781411B2

(12) United States Patent
Aidagulov et al.

(10) Patent No.: US 11,781,411 B2
(45) Date of Patent: Oct. 10, 2023

(54) METHODS AND SYSTEMS FOR REDUCING HYDRAULIC FRACTURE BREAKDOWN PRESSURE VIA PRELIMINARY COOLING FLUID INJECTION

(71) Applicant: Schlumberger Technology Corporation, Sugar Land, TX (US)

(72) Inventors: Gallyam Aidagulov, Dhahran (SA); Mustapha Abbad, Dhahran (SA); Devon Chikonga Gwaba, Kennesaw, GA (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 17/526,123

(22) Filed: Nov. 15, 2021

(65) Prior Publication Data

US 2022/0154566 A1 May 19, 2022

(30) Foreign Application Priority Data

Nov. 13, 2020 (WO) ..... PCT/US2020/060354

(51) Int. Cl.

| | |
|---|---|
| ***E21B 43/26*** | (2006.01) |
| ***E21B 21/06*** | (2006.01) |
| ***E21B 47/07*** | (2012.01) |
| ***E21B 43/267*** | (2006.01) |

(52) U.S. Cl.

CPC ..... *E21B 43/2607* (2020.05); *E21B 21/06* (2013.01); *E21B 43/26* (2013.01); *E21B 43/267* (2013.01); *E21B 47/07* (2020.05)

(58) Field of Classification Search

CPC ..... E21B 43/2607; E21B 21/06; E21B 43/26; E21B 43/267; E21B 47/07

See application file for complete search history.

(56) References Cited

U.S. PATENT DOCUMENTS

| | | | | |
|---|---|---|---|---|
| 4,476,932 | A * | 10/1984 | Emery | E21B 43/26 166/308.1 |
| 4,660,643 | A * | 4/1987 | Perkins | E21B 43/26 166/308.1 |
| 4,705,113 | A * | 11/1987 | Perkins | E21B 36/001 166/308.1 |
| 5,653,287 | A | 8/1997 | Wilson et al. | |
| 9,784,085 | B2 | 10/2017 | Liu et al. | |
| 10,422,207 | B2 | 9/2019 | Aidagulov et al. | |
| 2013/0192834 | A1 | 8/2013 | Schneider | |
| 2016/0201440 | A1 | 7/2016 | Aidagulov et al. | |
| 2016/0237341 | A1 | 8/2016 | Bhamidipati et al. | |
| 2016/0376884 | A1 | 12/2016 | Al-Nakhli et al. | |
| 2019/0055818 | A1 * | 2/2019 | Bulekbay | E21B 43/16 |

OTHER PUBLICATIONS

Al-Mahmoud, M.J. 2014. Pressure and thermal regimes and systems in the sedimentary sequence of central and eastern Saudi Arabia, Arab J Geosci, 8(8): 6249-6266.

(Continued)

*Primary Examiner* — James G Sayre
(74) *Attorney, Agent, or Firm* — Michael L. Flynn

(57) ABSTRACT

Method and systems and workflows are provided that cool a near-wellbore zone by injection of cooling fluid for reducing hydraulic fracture initiation (breakdown) pressure.

19 Claims, 10 Drawing Sheets

(56) References Cited

OTHER PUBLICATIONS

Albrecht, M., Feroze, N., Carrillo, G., Farid, U., Cook, P., Beylotte, J. 2009. Innovative Solution for Drilling Pre Khuff Formations in Saudi Arabia Utilizing Turbodrill and Impregnated Bits. Presented at the SPE Middle East Oil and Gas Show and Conference, Mar. 15-18, Manama, Bahrain. SPE-120367-MS.

Cha, M., Alqahtani, N.B., Yao, B., Yin, X., Kneafsey, T.J., Wang, L., Wu, Y., Miskimins, J.L. 2018. Cryogenic Fracturing of Wellbores Under True Triaxial-Confining Stresses: Experimental Investigation. SPE-180071-PA SPE J. 23(04):1271-1289.

Chang, F., Bartko, K., Dyer, S., Aidagulov, G., Suarez-Rivera, R., Lund, J. 2014. Multiple Fracture Initiation in Openhole Without Mechanical Isolation: First Step to Fulfill an Ambition. Presented at the SPE Hydraulic Fracturing Technology Conference, Feb. 4-6, The Woodlands, Texas, USA. SPE-168638-MS.

Detournay, E. and Carbonell, R. 1997. Fracture-Mechanics Analysis of the Breakdown Process in Minifracture or Leakoff Test. SPE Prod Fac 12(3): 195-199 SPE-28076-PA.

Gil, I.R., Roegiers, J.-C., Moos, D. 2006. Wellbore Cooling as a Means to Permanently Increase Fracture Gradient. Presented at the SPE Annual Technical Conference and Exhibition, Sep. 24-27, San Antonio, Texas, USA. SPE-103256-MS.

Hubbert, M.K. and Willis, D.G. 1957 Mechanics of Hydraulic Fracturing. Trans. Am. Inst. Min. Engrs, 210:153-163. SPE-686-G.

Oparin, M., Sadykov, A., Khan, S., Tineo, R. 2016. Impact of Local Stress Heterogeneity on Fracture Initiation in Unconventional Reservoirs: A Case Study from Saudi Arabia, Presented at the SPE Annual Technical Conference and Exhibition, Sep. 26-28, Dubai, UAE. SPE-181617-MS.

Perkins, T.K. and Gonzales, J.A. 1984. Changes in Earth Stresses Around a Wellbore Caused by Radially Symmetrical Pressure and Temperature Gradients. SPE J 24(02): 129-140. SPE-10080-PA.

Roy, P., Morris, J.P., Walsh, S.D.C., Lyer, J., Carroll, S. 2018. Effect of thermal stress on wellbore integrity during CO2 injection Int J Greenh Gas Con 77:14-26.

Stephens, G. and Voight, B. 1982. Hydraulic fracturing theory for conditions of thermal stress. Int J Rock Mech Min, 19(6): 279-284.

Uribe-Patino, J.A., Alzate-Espinosa, G.A., Arbelaez-Londono, A. 2017. Geomechanical aspects of reservoir thermal alteration: A literature review. J. Pet. Sci. Eng. 152:250-266.

Wu, R., Germanovich, L. N., Van Dyke, P. E., and Lowell, R. P. 2007. Thermal technique for controlling hydraulic fractures, J Geophys. Res., 112: B05209.

International Search Report and Written Opinion issued in PCT Application PCT/US2020/060354, dated Nov. 13, 2020 (11 pages).

International Preliminary Report on Patentability issued in PCT Application PCT/US2020/060354 dated May 25, 2023, 6 pages.

* cited by examiner

METHODS AND SYSTEMS FOR REDUCING HYDRAULIC FRACTURE BREAKDOWN PRESSURE VIA PRELIMINARY COOLING FLUID INJECTION

CROSS REFERENCE TO RELATED APPLICATIONS

This application claims the benefit of priority to International Patent Application PCT/US2020/060354, filed on Nov. 13, 2020, the entire content of which is incorporated herein by reference.

FIELD

The present disclosure relates to methods and systems that perform hydraulic fracture stimulation of subterranean rock formations, particularly for tight oil and gas reservoirs.

BACKGROUND

Hydraulic fracture stimulation, which is also referred to as hydraulic fracturing, can allow economic production from unconventional reserves, including tight oil and gas reservoirs. However, for complex tight oil and gas reservoirs, there are known cases where it is impossible to initiate a hydraulic fracture, or break down the formation, within the pressure limits of modern equipment. For example, see Oparin et. al., 2016 "Impact of Local Stress Heterogeneity on Fracture Initiation in Unconventional Reservoirs: A Case Study from Saudi Arabia," Presented at the SPE Annual Technical Conference and Exhibition, Sep. 26-28, 2016, Dubai, UAE. SPE-181617-MS. As a result, significant hydraulic fracturing cost can be lost without enabling production from the tight reservoir. Highly competent rock, large magnitudes of in-situ stresses and adverse stress contrasts due to increasing depths and active tectonics are all considered to be factors that contribute to the inability to break down the formation.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

Methods and systems are provided for hydraulic fracturing a subterranean rock formation traversed by a wellbore, which involve injecting a cooling fluid into a near-wellbore zone to cool the near-wellbore zone and thereby reduce fracture initiation pressure. Subsequent to injecting the cooling fluid, a frac fluid is injected into the cooled near-wellbore zone to initiate hydraulic fracture in the near-wellbore zone.

In embodiments, the frac fluid can have higher viscosity than the cooling fluid.

In embodiments, the cooling fluid can be selected from a group consisting of fresh water, brine, ethylene glycol, and liquefied or supercritical carbon dioxide.

In embodiments, the frac fluid includes a proppant suspended in the frac fluid.

In embodiments, the cooling fluid can be injected into the near-wellbore zone using a bottomhole assembly deployed on coiled tubing in an isolated wellbore interval.

In embodiments, the isolated wellbore interval can be isolated by a pair of isolation devices (such as multiset packers) that are deployed on the coiled tubing and straddle the bottomhole assembly.

In embodiments, the isolated wellbore interval can have a plurality of perforations that provide access to the near-wellbore zone for the cooling fluid injection and the frac fluid injection.

In embodiments, the volume of the cooling fluid that is pumped into wellbore and into the near-wellbore zone is measured while injecting the cooling fluid into the near-wellbore zone. The injection of the cooling fluid into the near-wellbore zone can be stopped when the measured volume matches a target volume.

In embodiments, the target volume can be configured to induce a predefined maximum temperature drop in the near-wellbore zone, where the near-wellbore zone extends at least three wellbore diameters beyond the wellbore and perforated zone of the formation.

In embodiments, the target volume can be based on estimates or measurements of temperature of the cooling fluid.

In embodiments, the target volume can be based on downhole measurements of temperature of the cooling fluid using coiled tubing telemetry, such as those derived from distributed temperature sensors.

In embodiments, the target volume can be based on estimates of formation temperature of the near-wellbore zone prior to injection of the cooling fluid.

In embodiments, the cooling fluid can be pumped through coiled tubing to an isolated wellbore interval adjacent the near-wellbore zone.

In embodiments, a secondary coolant can be circulated through additional smaller-diameter tubing laid out inside the coiled tubing to reduce warm-up of the cooling fluid as it flows through the coiled tubing.

In embodiments, a downhole chiller can be deployed on the coiled tubing, wherein the downhole chiller is configured to counteract warm-up of the cooling fluid at it flows through the coiled tubing.

In embodiments, a surface-located chiller can be configured to cool the cooling fluid for injection into the near-wellbore zone.

In embodiments, a tank can be configured to hold a supply of the cooling fluid for injection into the near-wellbore zone.

In embodiments, a surface-located pump can be configured to pump cooling fluid through coiled tubing to an isolated wellbore interval adjacent the near-wellbore zone and inject cooling fluid into a near-wellbore zone to cool the near-wellbore zone and thereby reduce fracture initiation pressure. The same pump or an additional surface-located pump can be further configured to pump frac fluid through the coiled tubing to the isolated wellbore interval and into the near-wellbore zone to initiate hydraulic fractures in the near-wellbore zone.

BRIEF DESCRIPTION OF DRAWINGS

The subject disclosure is further described in the detailed description which follows, in reference to the noted plurality of drawings by way of non-limiting examples of the subject disclosure, in which like reference numerals represent similar parts throughout the several views of the drawings, and wherein.

DETAILED DESCRIPTION

The particulars shown herein are by way of example and for purposes of illustrative discussion of the embodiments of the subject disclosure only and are presented in the cause of providing what is believed to be the most useful and readily understood description of the principles and conceptual aspects of the subject disclosure. In this regard, no attempt is made to show structural details in more detail than is necessary for the fundamental understanding of the subject disclosure, the description taken with the drawings making apparent to those skilled in the art how the several forms of the subject disclosure may be embodied in practice. Furthermore, like reference numbers and designations in the various drawings indicate like elements.

The present disclosure provides a method of hydraulic fracture stimulation where a near-wellbore zone of the formation is cooled by injection of a cooling fluid prior to a hydraulic fracturing operation that injects frac fluid into the cooled near-wellbore zone in order to initiate or induce hydraulic fracture in the formation.

Figure 1:
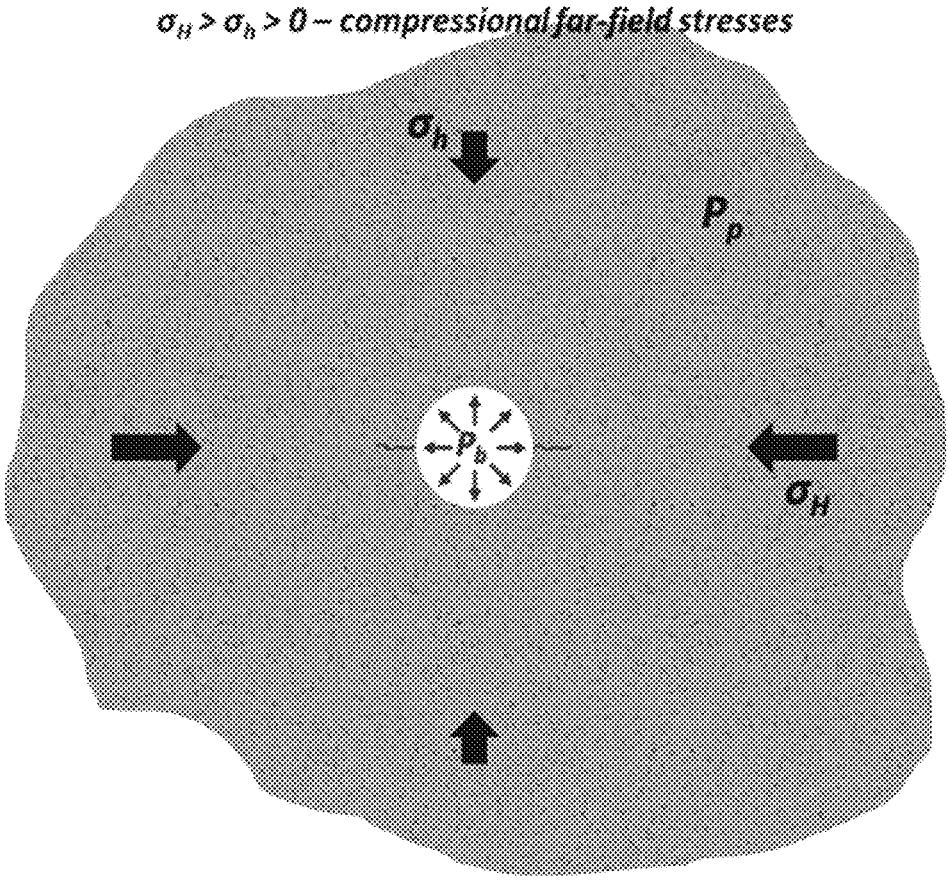
FIG. 1 is a schematic diagram of hydraulic fracture initiation in a vertical openhole wellbore.

The initiation of hydraulic fractures in a formation is illustrated by FIG. 1, by example of a horizontal cross-section of the vertical openhole wellbore drilled in an infinite linear elastic isotropic rock. In the course of the hydraulic fracturing operation, the wellbore is loaded by far-field stresses $\sigma_H > \sigma_h$ and becomes pressurized by increasing wellbore pressure. Once the wellbore pressure reaches the critical pressure $P_b$, hydraulic fracture initiates. In such a configuration, hydraulic fractures initiate along the wellbore perpendicular to the minimal horizontal far-field stress $\sigma_h$. Here, the critical fracture initiation (breakdown) pressure in the wellbore $P_b$ can be determined from a well-known equation as follows:

$$P_b = T_{str} - P_p + 3\sigma_h - \sigma_H, \tag{1}$$

where $T_{str}$ is the tensile strength of the rock and $P_p$ is the pore pressure.

Equation (1) is described in Hubbert, M. K. and Willis, D. G., "Mechanics of Hydraulic Fracturing," Trans. Am. Inst. Min. Engrs, 210: 153-163, 1957, SPE-686-G; and Detournay, E. and Carbonell, R., "Fracture-Mechanics Analysis of the Breakdown Process in Minifracture or Leakoff Test. SPE Prod & Fac, 12(3): 195-199, 1997, SPE-28076-PA. Equation (1) illustrates the role of the vertical wellbore as a stress concentrator within a rock mass loaded by the far-field horizontal principal stresses $\sigma_H$ and $\sigma_h$. For the hydraulic fracture to initiate, it is required that the tangential (hoop) stress at the wellbore due to wellbore pressurization reaches the tensile strength of the rock $T_{str}$ (though reduced by the value of pore pressure $P_p$) combined with the near-wellbore compressive stress concentration ($3\sigma_h - \sigma_H$). The latter can reach twice the value of the fracture closure stress $\sigma_h$, in case of equal far-field stresses $\sigma_H = \sigma_h$, and become significantly high in deep reservoirs with strong tectonic component. Two essential ways have been used to reduce the hydraulic fracture initiation pressure.

First, the hydraulic fracture initiation pressure can be reduced by forming defects in the wellbore wall where such defects are configured to locally increase tensile stresses in desired directions. For example, such defects can be 360° perforations or circular notches as described in i) Chang, F., Bartko, K., Dyer, S., Aidagulov, G., Suarez-Rivera, R., Lund, J., "Multiple Fracture Initiation in Openhole Without Mechanical Isolation: First Step to Fulfill an Ambition," Presented at the SPE Hydraulic Fracturing Technology Conference, 4-6 Feb. 2014, The Woodlands, Tex., USA. SPE-168638-MS; ii) Liu, H. and Montaron, B. A., "Method of Transverse Fracturing of Subterranean Formation," U.S. Pat. No. 9,784,085. 2017; iii) Aidagulov, G., Brady, D., Edelman, E., "Methods for creating multiple hydraulic fractures in oil and gas well," U.S. Pat. No. 10,422,207B2, 2019; and iv) Aidagulov, G., Stukan, M., Dyer, S., "Fracture Initiation with Auxiliary Notches," US Patent Application 2016/0201440A1, 2016.

Second, the hydraulic fracture initiation pressure can be reduced by reducing the compressive stress concentration in wellbore vicinity. In this case, if the rock mass is constrained, rock temperature variations induce additional thermal stresses inside the rock which can be compressional or tensile. When the formation near the wellbore is cooled down, rock near the wellbore shrinks moving the zone of high compressional stresses away from the borehole. Stephens, G. and Voight, B., "Hydraulic fracturing theory for conditions of thermal stress," Int J Rock Mech Min, 19(6): 279-284, 1982, demonstrates the effect of the thermal stresses on fracture initiation pressure. Specifically, a variation in tangential (hoop) stress at the wall of the borehole, caused by a change in borehole temperature by $\Delta V$, will modify the breakdown pressure formula (1) as follows:

$$P_b^{th} = T_{str} - P_p + 3\sigma_h - \sigma_H + \frac{\alpha E \Delta V}{1-\nu}, \quad (2)$$

where $\alpha$ is a thermal expansion coefficient of the rock; E–Young's modulus and $\nu$ is the Poisson's ratio of the rock. Taking typical values for rock of $\alpha=10\times10^{-6}$° C.$^{-1}$, $\nu=0.2$ and $E=8\times10^6$ psi, then the variation in fracture breakdown pressure becomes:

$$P_b^{th} - P_b = \frac{10\times10^{-6}\times8\times10^6}{1-0.2}\times\Delta V = 100\times\Delta V. \quad (3)$$

Thus, according to equation (3), decreasing the borehole temperature by only 10° C. will result in fracture breakdown pressure reduction by 1,000 psi. Note that borehole temperatures generally increase with depth and can reach significantly high values. For example, Pre-Khuff gas bearing formations in Saudi Arabia can be encountered at depths between 13,000 and 17,000 feet where unconfined compressive strength of the rock can be as high as 40,000 psi and borehole temperatures can reach 177° C. (350° F.) as described in Albrecht, M., Feroze, N., Carrillo, G., Farid, U., Cook, P., Beylotte, J., "Innovative Solution for Drilling Pre Khuff Formations in Saudi Arabia Utilizing Turbodrill and Impregnated Bits. Presented at the SPE Middle East Oil and Gas Show and Conference, Mar. 15-18, 2009, Manama, Bahrain. SPE-120367-MS. Thus, for deep and hot reservoirs, where in-situ temperatures may reach 150° C. to 180° C., this will mean significant breakdown pressure reduction of a few thousands psi and thus would practically be very relevant and beneficial.

One should note that the injected fluid does not have to be at a cryogenic temperature below −180° C. (93 K; −292° F.). Indeed, according to the equation (3), in the case of a hot reservoir, water delivered downhole even at 20° C. is expected to cause significant near-wellbore stress reduction when pumped into the formation.

Note that equation (2) above is obtained utilizing an analytical solution to the heat conduction equation derived for internally bounded cylindrical geometry, which corresponds to the case of conductive heat transfer in porous rock. The conductive heat transfer mechanism predominates in rocks with very low permeability as described in Uribe-Patiño, J. A., Alzate-Espinosa, G. A., Arbeláez-Londoño, A., "Geomechanical aspects of reservoir thermal alteration: A literature review," J. Pet. Sci. Eng. 152: 250-266, 2017. However, in cases of rocks with higher permeability and/or when coolant fluid viscosity is low (such as in cases of water or liquified or supercritical carbon dioxide), one also needs to consider the convective heat transfer mechanism. The latter can make the formation cooling more efficient by making the zone of reduced temperature around the wellbore more uniform and penetrating further into the reservoir compared to the result of conductive heat transfer alone.

Figure 2:
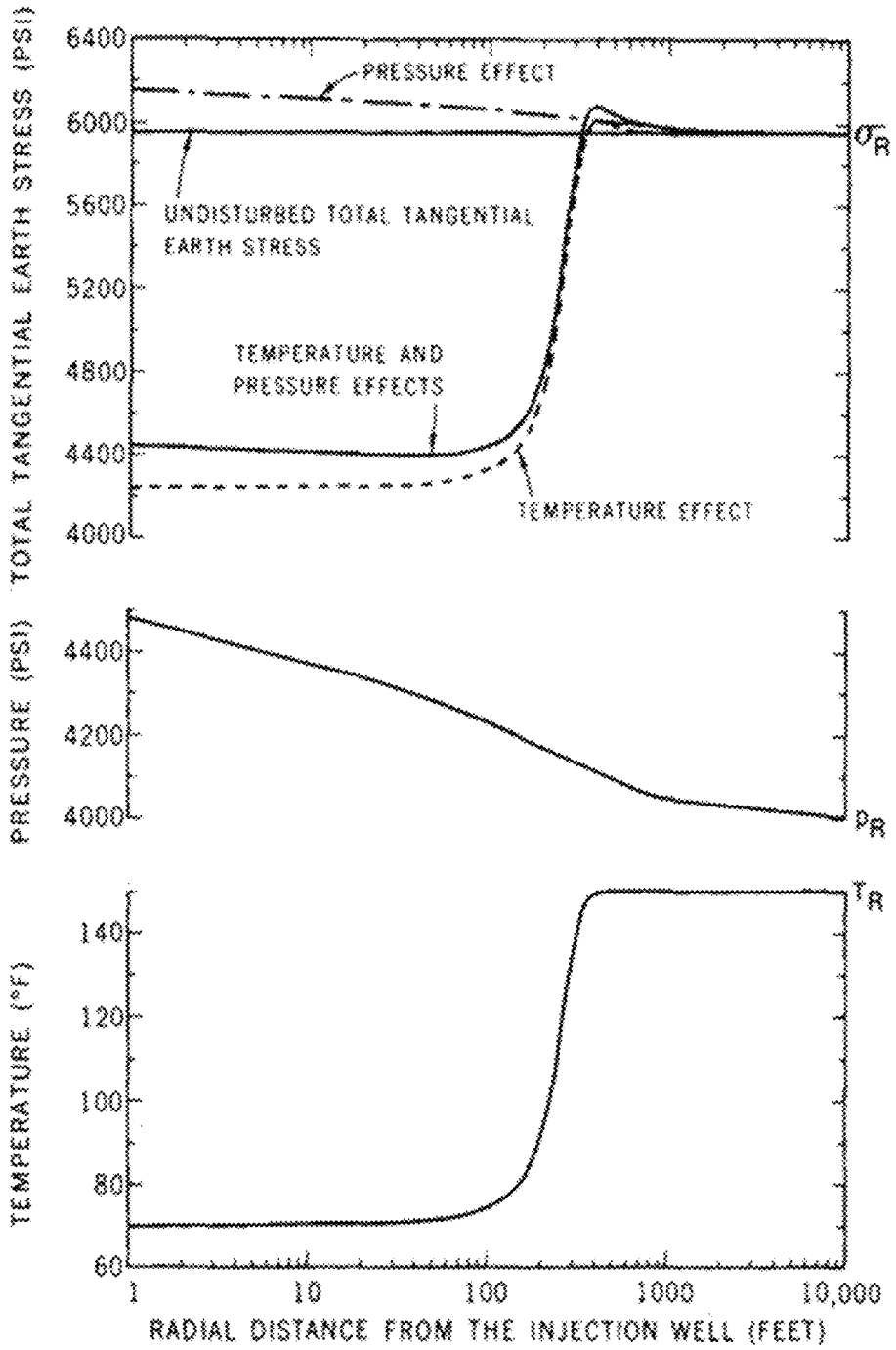
FIG. 2 depicts radial profiles of pore pressure (middle), temperature (bottom) and resulting total tangential (hoop) stresses (top) around a water injector well, with a water injection rate of 3,000 bpd [477 m3/d], injected water temperature of 70° F. [21° C.], initial reservoir temperature of 150° F. [66° C.], duration of injection of 3 years, reservoir thickness of 100 ft [30.5 m], reservoir permeability of 200 md, and reservoir porosity of 25%.

Perkins, T. K. and Gonzales, J. A., "Changes in Earth Stresses Around a Wellbore Caused by Radially Symmetrical Pressure and Temperature Gradients," SPE J 24(02): 129-140, 1984, SPE-10080-PA, provides a simulation case demonstrating a clear reduction in formation stresses around the well due to continuous cold-water injection. Assuming the axisymmetric flow conditions around the vertical wellbore, a two-dimensional numerical reservoir simulation model was used for the most accurate simulation of oil displaced by cold water, accounting for both conductive and convective heat transfer within a reservoir as well as heat conduction from the overlying and underlying strata. The obtained pore pressure and temperature profiles were then substituted into a poroelastic stress model to compute the distribution of total tangential stresses around the wellbore. FIG. 2 contains the simulation results for the water injection rate of 3,000 bpd (477 m3/d); injected water temperature: 70° F. (21° C.), initial reservoir temperature: 150° F. (66° C.); duration of injection: 3 years; reservoir thickness: 100 ft (30 m); reservoir permeability: 200 md; reservoir porosity: 25%. The middle and bottom plots show the computed radial profiles of reservoir pore pressure and temperature, respectively. As expected for an injector well, pore pressure decreases to the reservoir value of 4,000 psi, as one moves away from the wellbore. Opposite to pore pressure, one can see roughly 300 ft (91 m) deep zone around the wellbore where the reservoir temperature has been reduced by the cold water which filtrated through it. As can be seen from the top plot, induced thermal stresses exceeded pore pressure buildup from the water injection. This resulted in the zone of reduced total tangential stresses which spans for about 300 ft (91 m) away from the wellbore. Noteworthy, in the first 100 ft (30 m) from the wellbore, total tangential stress was reduced uniformly by almost 1,600 psi.

Figure 3:
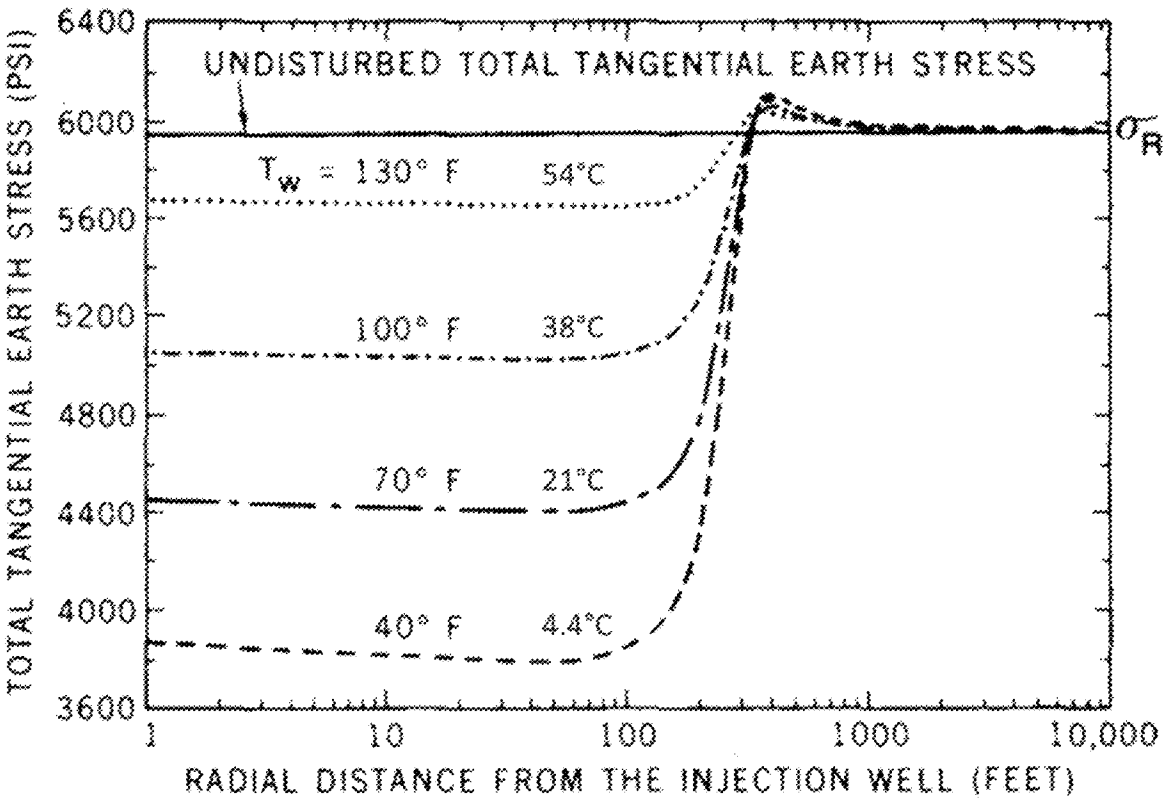
FIG. 3 depicts plots of variation in total tangential (hoop) stress with distance from the injection well computed for several water-injection temperatures, with a water injection rate of 3,000 bpd [477 m3/d], and an initial reservoir temperature of 150° F. [66° C.], duration of water injection of 3 years, reservoir thickness of 100 ft [30.5 m], reservoir permeability of 200 md, and reservoir porosity of 25%.

FIG. 3 shows variation in total tangential stress with distance from the injection well computed for several water-injection temperatures. One can see that for the range of temperature contrasts, the zone of reduced tangential stresses spans for the same 100 ft (30 m) from the wellbore which is defined by injection duration and convective and conductive heat transfer rates. Overall, one can see that in some cases injection of a cold fluid can significantly reduce tangential stresses around an injection well, which can reduce the pressure at which vertical hydraulic fractures can be initiated and propagated.

Note that cooling down the formation for 3 years is too long and requires prohibitively large volumes of water (or any other cold fluid) to become a practical solution to high breakdown pressure problems encountered in routine fracture stimulation jobs. Meanwhile, a 300 ft deep zone of the reduced stresses around the borehole spans much farther beyond the near-wellbore stress concentration region and is not really needed. Note that Perkins and Gonzales (1984) did not provide simulated stress profiles during the 3 years of continuous water injection. However, a reasonable estimate can be made by expecting the zone of reduced tangential stresses to grow proportionally to the volume of injected water. In that case, reducing the tangential stress just within 6 ft (1.8 m) around the wellbore, will require cold water injection for:

$$\frac{3\times365}{\left(\frac{300}{6}\right)^2} = \frac{1095}{2500} = 0.438 \text{ days}. \quad (4)$$

According to equation (4), injecting the cold water for about 0.5 day into 100 ft long stimulated openhole section would reduce the tangential stresses within 6 ft around the wellbore, which is around 12 wellbore diameters (for 5⅞ in. borehole) and extends beyond the near-wellbore stress concentration region. This becomes a sufficient and feasible practice to reduce the fracture initiation pressure during the following main fracturing job injection. For a few perforation clusters isolated within cemented and cased stimulated stage, "reservoir thickness" becomes really small, and volume of injected cold water and water injection time are expected to drop even further.

Furthermore, there is the challenge of how to efficiently deliver cold fluid to the target measured depths (MD) of 20,000 ft and larger for the case of horizontal wells drilled into deep, tight, and hot reservoirs. Here the objective is to deliver the fluid to the downhole stimulated section at the lowest possible temperature minimizing its warm-up by contacting casings, tubings, cement, rock as it flows down the wellbore.

For purposes of reducing the fracture initiation pressure, it is necessary to create a sufficient temperature gradient (cooling) in the near-wellbore zone where hydraulic fracture is desired. One of the best ways to do that is to pump the cooling fluid through coiled tubing that is run to the target wellbore interval. Compared to non-targeted bullhead injection, this way will also allow the cooling fluid to reach the target wellbore interval faster and thus minimize the time for the cooling fluid to warm-up as it flows to the depth of the target wellbore interval.

Figure 4:
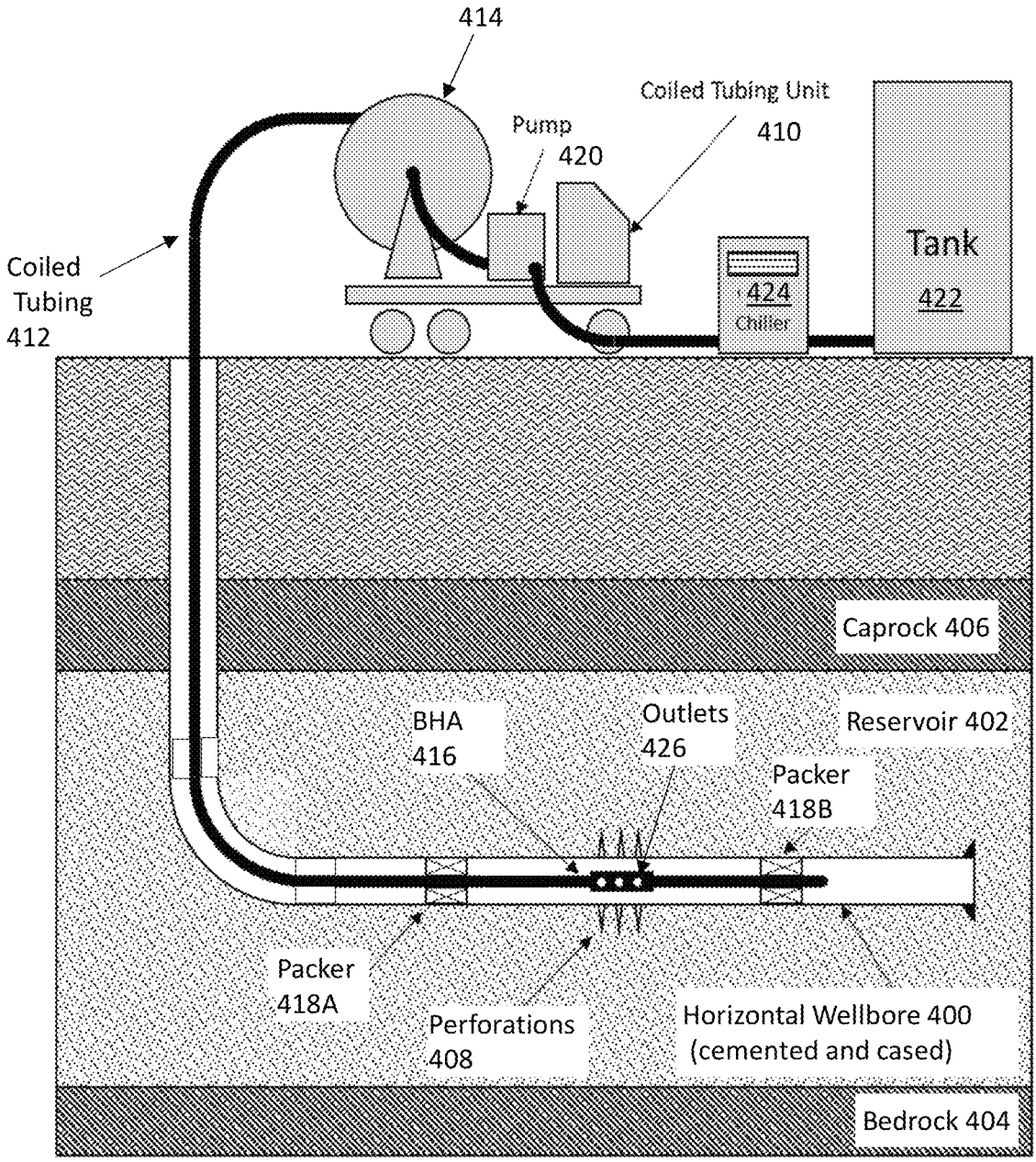
FIG. 4 depicts a wellsite system with a cased horizontal well that traverses a reservoir formation, where an interval of the horizontal well is perforated for access to the reservoir formation and a bottom hole assembly (BHA) is conveyed on coiled tubing and positioned in a perforated interval of the well; cooling fluid is pumped from the surface down the coiled tubing to the BHA to cool down a near-wellbore zone adjacent the perforated interval of the well prior to hydraulic fracture stimulation.

An embodiment of a wellsite system that pumps cooling fluid through coiled tubing down to a target wellbore interval is shown in FIG. 4. In this embodiment, a cased/cemented wellbore 400 traverses an earth formation that includes a reservoir 402 (such as a tight oil or gas reservoir) disposed above bed rock 404 and below cap rock 406. An interval of a generally horizontal section of the wellbore 400 that extends through the reservoir 402 is perforated (with perforations 408) to provide access to the reservoir 402. A surface-located coiled tubing unit 410 provides coiled tubing 412 wound on a reel 414. The coiled tubing 410 is deployed from the reel 414 into the wellbore 400 typically via a gooseneck, coil tubing injector, and wellhead (not shown). A bottom hole assembly (BHA) 416 and a pair of isolation devices (e.g., coiled-tubing multiset packers) 418A, 418B are deployed on the lower end of the coiled tubing 412 in the wellbore 400. The BHA 416 is disposed between the isolation devices 418A, 418B as shown.

Figure 7:
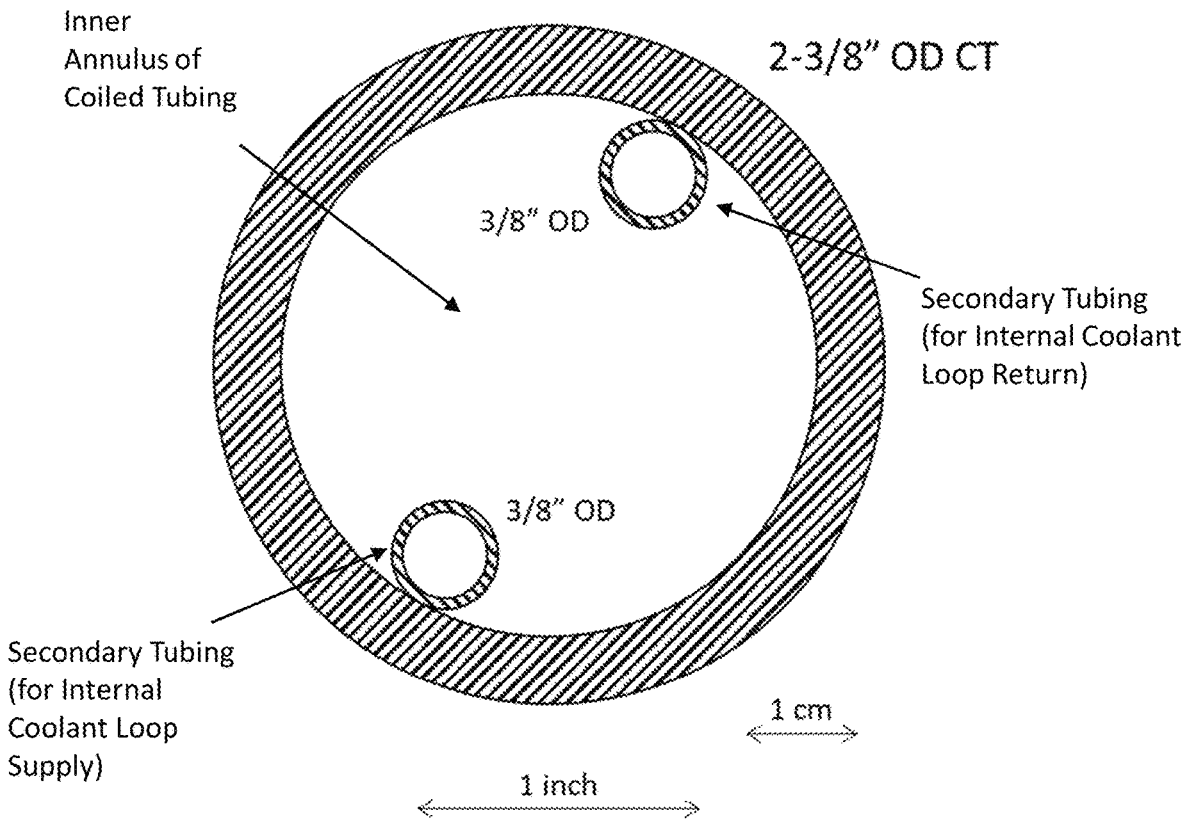
FIG. 7 is a schematic diagram of coiled tubing with additional smaller diameter tubings that are contained within the inner annulus of the coiled tubing and configured to carry a secondary coolant to reduce or counteract warm-up of cooling fluid as it is pumped through the coiled tubing.

The coiled tubing unit 410 includes a pump 420. A tank or reservoir 422 is provided on the surface and holds a supply of cooling fluid (such as water or other cooling fluid). A chiller 424 is located at the surface and is fluidly coupled inline between the tank 422 and the inlet of the pump 420. The outlet of the pump 420 is fluidly coupled to the inner channel/annulus of the coil tubing 412 (FIG. 7). The BHA 416 includes outlet ports 426 that are in fluid communication with the inner channel/annulus of the coil tubing 412. In this configuration, the chiller 424 can be configured and operated to cool the cooling fluid held in the tank 422 to a temperature within a desired cold temperature range for supply to the pump 420, and the pump 420 can be configured and operated to pump the cooling fluid supplied by the chiller 424 through the inner channel/annulus of the coiled tubing 412 and down to the outlet ports 426 of the BHA 416. In other embodiments, the chiller 424 can be configured as an indirect cooler that cools the fluid held in the tank 422 to a temperature within a desired cold temperature range. In this configuration, the cooling fluid held in the tank 422 can be supplied from the tank 422 to the inlet of the pump 420. In still other embodiments, the tank 422 can hold cooling fluid at sufficiently low temperatures such that the chiller can be omitted. This embodiment may be suitable in cold environments. The temperature of the cooling fluid supplied to the pump 420 can be measured by one or more temperature sensors (not shown), which can be part of the chiller 424, the tank 422, or the supply piping that carries the cooling fluid to the pump 420.

Figure 5:
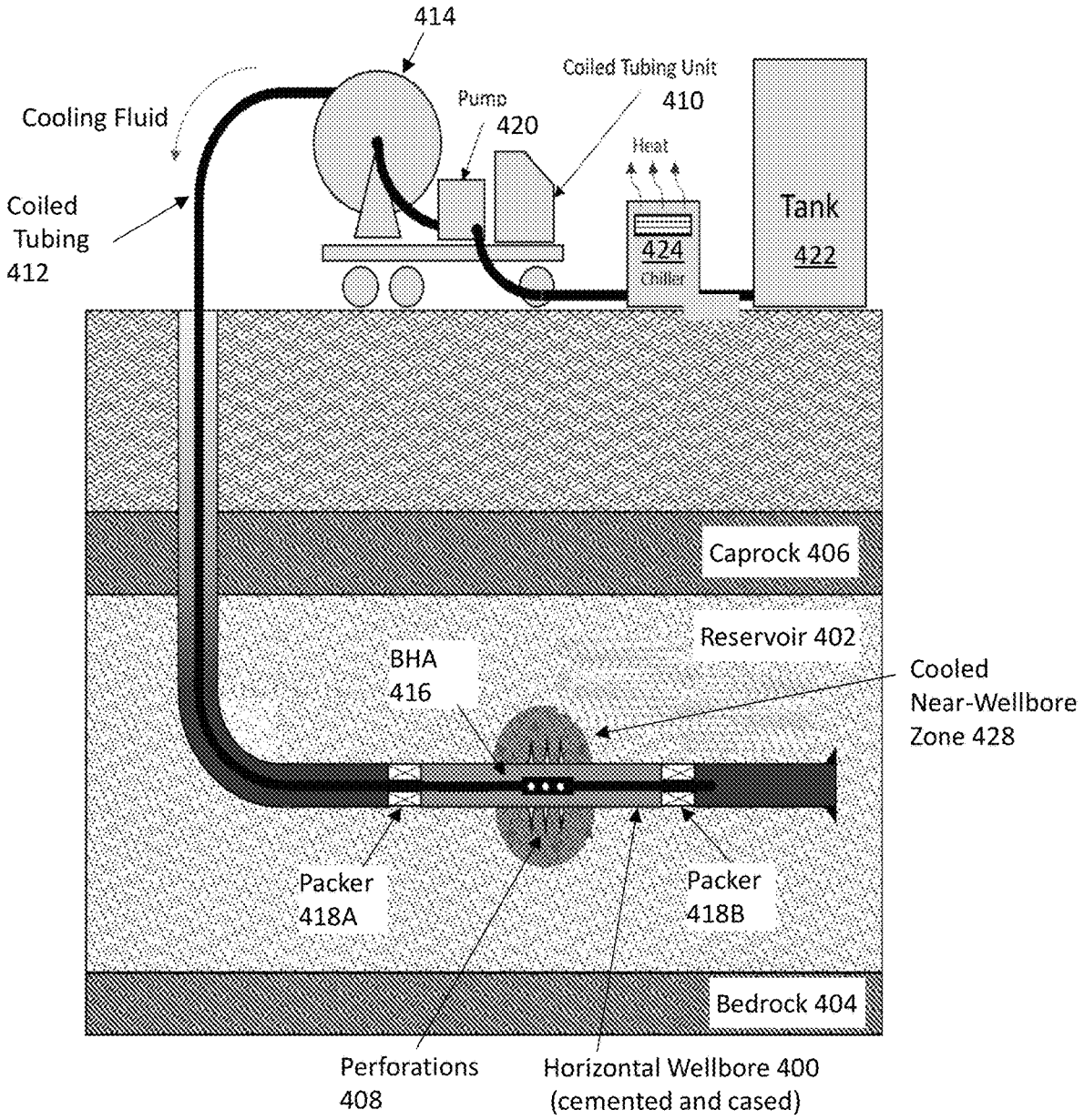
FIG. 5 depicts the wellsite system of FIG. 4 with a cooled near-wellbore zone formed by injection of cooling fluid into and through the perforated interval of the cased well.

Furthermore, the isolation devices 418A, 418B can be deployed at a desired wellbore interval (such as at positions straddling the perforated interval with perforations 408 as shown) and configured and operated to seal to the casing of the wellbore 400, thus isolating the short perforated wellbore interval that spans the distance between the isolation devices 418A, 418B. The reservoir temperature in the near-wellbore region adjacent the perforated wellbore interval (prior to injection of cooling fluid) can be estimated from one or more temperature sensors (not shown) disposed in the wellbore, such as distributed temperature sensors that are part of or secured to the BHA 416 and coiled tubing 412 or part of or secured to the casing of the wellbore. The isolation of the perforated wellbore interval provided by the isolation devices 418A, 418B can be used in conjunction with the operation of the pump 420, pumping the cooling fluid through the inner channel/annulus of the coil tubing 412 and down to the outlet ports 426 of the BHA 416 such that the cooling fluid is injected into the isolated perforated wellbore interval under pressure. As such injection continues, the cooling fluid flows through the perforations 408 and penetrates the near-wellbore zone of the formation displacing reservoir fluids and cooling down the near-wellbore zone of the formation, thus producing a cooled near-wellbore zone 428 as shown in FIG. 5. In the cooled near-wellbore zone 428, the formation rock shrinks reducing the compressive stresses in this near-wellbore zone 428 and moving concentrations of compressive stresses farther away from the perforations 408 into the reservoir rock.

Figure 6A:
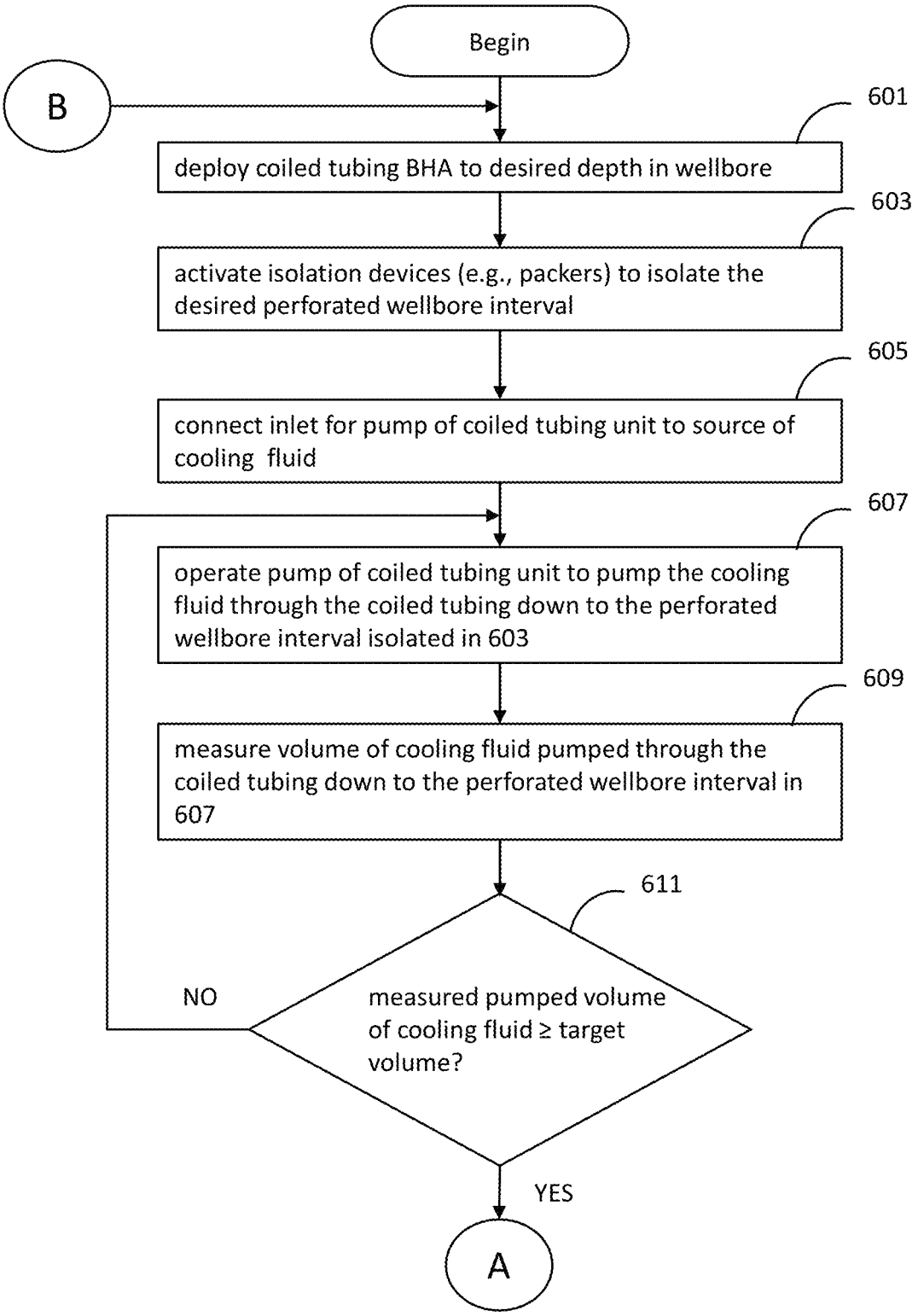
FIGS. 6A and 6B, collectively, is a flowchart of a workflow that employs the wellsite system of FIG. 4 for reducing hydraulic fracture initiation (breakdown) pressure.
Figure 6B:
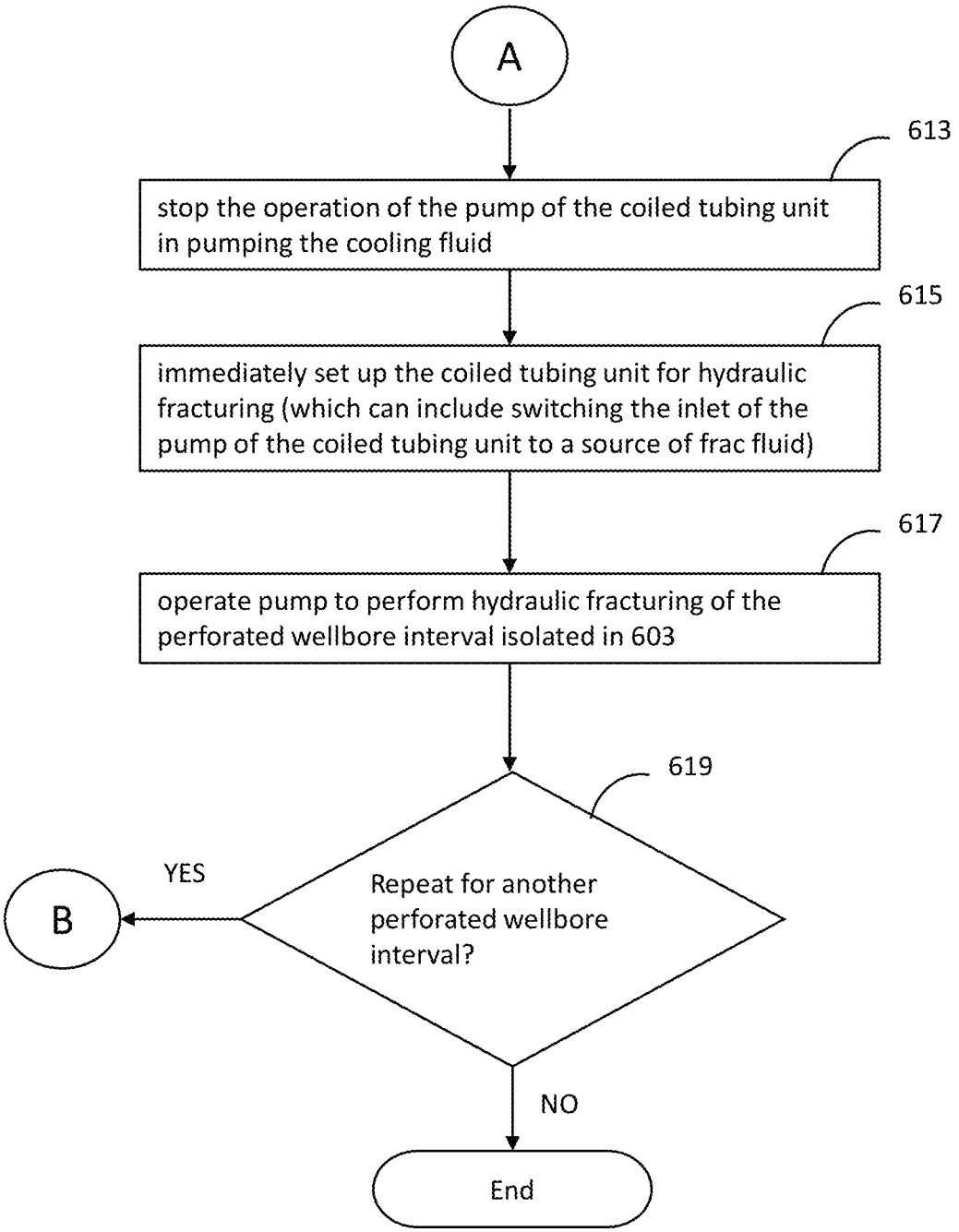

An example workflow that employs the wellsite system of FIGS. 4 and 5 for reducing hydraulic fracture initiation (breakdown) pressure is shown in the flowchart of FIGS. 6A and 6B. The workflow begins in block 601 where the coiled tubing BHA 416 is deployed to a desired depth in wellbore 400.

In block 603, the isolation devices (e.g., packers) 418A, 418B are activated to isolate the desired perforated wellbore interval.

In block 605, the inlet of the pump 420 of the coiled tubing unit 410 is connected to a source of cooling fluid, such as the supply line output from the chiller 424 as fed from the tank 422.

In block 607, the pump 420 of the coiled tubing unit is operated to pump the cooling fluid through the coiled tubing 412 down to the perforated wellbore interval isolated in block 603.

In block 609, the volume of cooling fluid pumped through the coiled tubing 412 down to the perforated wellbore interval in block 607 is measured. Such measurement can be performed by a surface-located flow meter that measures the flow rate of the cooling fluid pumped through the coiled tubing 412 over time. The pumped volume for any period of time can be derived by integrating the measured flow rates over that time period. Alternatively, one can monitor the level of the cooling fluid in the tank 422.

In block 611, operations check whether the pumped volume of cooling fluid as measured in block 609 matches (e.g., is greater than or equal) to a target volume. In embodiments, the target volume can be configured or designed to induce a predefined maximum temperature drop (decrease in temperature) in a near-wellbore zone 428 that extends at least 3 (three) wellbore diameters beyond the wellbore and perforated zone. This temperature drop will move the compressional stress concentration away from perforations and allows for hydraulic fracture initiation at lower pressure. In embodiments, this target volume can be determined by reservoir thermal flow modeling based on the length of an isolated target well interval, the temperature of the reservoir at or near the near-wellbore zone before injection of the cooling fluid (which can be measured by one or more temperature sensors disposed in the wellbore as described above), thermal characteristics of the reservoir fluids and possibly wellbore fluids (such as drilling mud), and temperature as well as thermal characteristics of the cooling fluid. The downhole temperature of the cooling fluid can be estimated from the cooling fluid temperature at the surface or possibly by downhole temperature measurements, such as distributed temperature sensors as described herein. The cooling fluid temperature at the surface can be measured by temperature sensors or possibly defined by the temperature setpoint of the chiller as described herein. If the condition of block 611 is not satisfied (in other words, the pumped volume of cooling fluid as measured in block 609 is less than the target volume), the operations continue to repeat the pumping of the cooling fluid (block 607), the measurement of pumped volume (block 609), and the check of the pumped volume condition (block 611). If the condition of block 611 is satisfied (in other words, the pumped volume of cooling fluid as measured in block 609 matches the target volume), the operations continue to blocks 613 to 617. The operations of block 611 can be performed manually by a human operator, or semi-manually or automatically involving operation of an automated controller or control system.

In block 613, the operation of the pump 420 of the coiled tubing unit 410 in pumping the cooling fluid is stopped.

In block 615, the coiled tubing unit 410 is immediately setup for hydraulic fracturing. This setup can include switching the inlet of the pump 420 of the coiled tubing unit 410 to a source of frac fluid. Alternatively, the setup can include connecting another high-pressure pump to the coiled tubing 412 such that the pump can pump the frac fluid through the inner channel/annulus of the coil tubing 412.

In block 617, the pump 420 (or other high-pressure pump) is operated to pump frac fluid through the inner channel/annulus of the coil tubing 412 and perform hydraulic fracturing of the perforated wellbore interval isolated in 603. In the hydraulic fracturing, the frac fluid is injected into the isolated perforated wellbore interval and through the perforations 408 and against the face of the formation at a pressure and flow rate at least sufficient to overcome the minimum principal stress in the reservoir and extend a fracture(s) into the formation. The frac fluid typically includes a proppant such as 20-40 mesh sand, bauxite, glass beads, etc., suspended in the frac fluid and transported into a fracture. The proppant then keeps the formation from closing back down upon itself when the pressure is released. The proppant filled fractures provide permeable channels through which the formation fluids can flow to the wellbore and thereafter be withdrawn.

In block 619, a check is made whether to repeat the operations of the workflow for another perforated interval of the wellbore. If the condition of block 619 is satisfied (in other words, the operations of the workflow are to be repeated for another perforated interval of the wellbore), the operations continue to repeat blocks 601 to 619 for another perforated interval of the wellbore. Otherwise, the workflow ends. The operations of block 619 can be performed manually by a human operator, or semi-manually or automatically involving operation of an automated controller or control system.

In embodiments, the frac fluid that is pumped through the inner channel/annulus of the coil tubing 412 and performs hydraulic fracturing of the formation rock in block 617 has higher viscosity than the cooling fluid pumped through the coil tubing 412 in block 607 and will initially displace the residual cooling fluid in the coiled tubing and in the cooled near-wellbore zone 428. As the frac fluid is viscous and injection rate is high, the frac fluid (which is not necessarily cold), is not expected to penetrate deeply to the rock warming it back. Instead, fluid pressure in the isolated interval raises and initiates the fracture. Furthermore, once hydraulic fracture has been initiated, it is expected to be much easier to propagate it further to the zone of reservoir temperature and stress, compared to the conventional hydraulic fracturing practice without pre-cooling the formation. As a result, hydraulic fracture breakdown pressure is lowered thus breaking the intervals which otherwise cannot be fractured.

The efficiency of the proposed hydraulic fracturing technique depends strongly on the contrast between the temperature of the injected cooling fluid and the reservoir temperature (prior to cooling). In that regard, a variety of cooling fluids can be used, such as water (fresh water or brine), ethylene glycol, and liquefied or supercritical carbon dioxide. The main benefit here is from the ability to inject the cooling fluid even at temperatures at which water freezes. The viscosity of the cooling fluid can also be considered as it affects pressure loss in coiled tubing as well as its injectivity into the formation. Here, supercritical carbon dioxide may be preferred to water, as it has lower viscosity and lower freezing point. Also, from carbon dioxide sequestration studies, it is known that carbon dioxide can be injected at low downhole temperatures. See Roy, P., Morris, J. P., Walsh, S. D. C., Lyer, J., Carroll, S., "Effect of thermal stress on wellbore integrity during CO2 injection," Int J Greenh Gas Con 77:14-26, 2018.

In embodiments, the temperature of the cooling fluid as it reaches the isolated wellbore interval can either be estimated or measured using the available coiled tubing telemetry, like distributed temperature sensing systems.

Modifications can be made to the wellsite system in order to avoid warm-up of the cooling fluid as it is pumped through the coiled tubing to the BHA and the isolated wellbore interval.

For example, additional smaller diameter tubings can be provided inside the inner annulus of the coiled tubing 412 to provide supply and return lines as shown in FIG. 7. The smaller diameter supply and return lines can be configured to circulate a secondary coolant along the whole length of coiled tubing 412 to compensate or counteract the warm-up of the cooling fluid as it flows through the inner annulus of the coiled tubing 412. FIG. 7 illustrates the scaled schematic of 2⅜ in. OD coiled tubing with two ⅜ in. OD lines laid inside for the smaller diameter supply and return lines. Note that a single ⅜' inch OD line occupies less than 4% of the total inner flow area of the inner annulus of the coiled tubing and will not raise differential pressure considerably. A single pair or multiple pairs of smaller diameter inflow and return lines can be used to circulate the secondary coolant along the whole length of coiled tubing to compensate or counteract for the cooling fluid warm-up.

Figure 8:
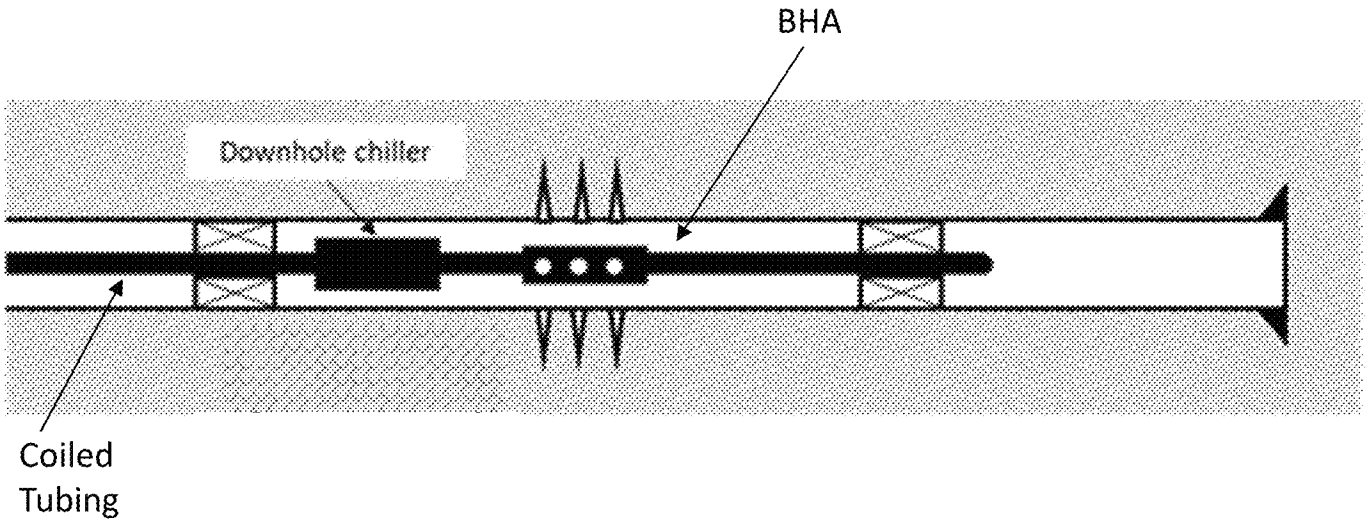
FIG. 8 is a schematic diagram of the BHA of FIGS. 4 and 5, which is equipped with downhole chiller configured to counteract warm-up of cooling fluid as it is pumped through the coiled tubing.
Figure 9:
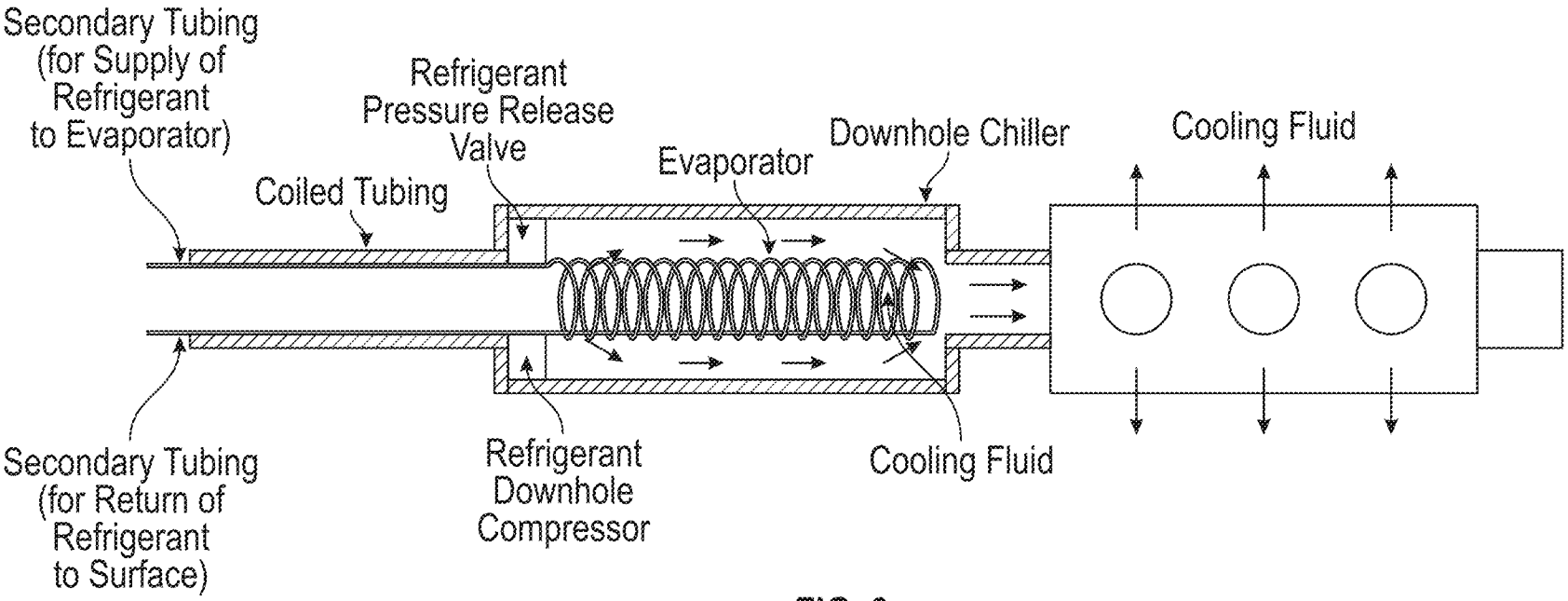
FIG. 9 is a schematic diagram showing the operation of downhole chiller depicted in FIG. 8.

In another example, the BHA 416 can be equipped with a downhole inline chiller as shown in FIGS. 8 and 9. In the embodiment, the cooling fluid that is pumped down the coil tubing 412 flows through the downhole chiller as it reaches the BHA 416. The downhole chiller includes an evaporator disposed inside this chiller that cools down the cooling fluid just before it flows out the outlets 426 of the BHA 416. Here, it is assumed that a main compressor on the surface liquefies refrigerant gas and pumps it down via a high-pressure supply line laid inside the coiled tubing. Due to the pressure release valve, refrigerant pressure drops inside the evaporator and it cools down thereby cooling the cooling fluid passing through the evaporator. A small downhole compressor is also installed inside the housing of downhole chiller. This compressor sustains the low pressure inside the evaporator by taking the refrigerant gas from the evaporator and pumping it through a low pressure return line laid inside the coiled tubing back to the surface. This downhole compressor can be powered by the flow of the main cooling fluid passing through the chiller or via separate electrical cable laid inside the coiled tubing. The high-pressure supply line and the low-pressure return line for the refrigerant can be smaller-diameter tubing laid out inside the coiled tubing similar to the embodiment of FIG. 7.

There have been described and illustrated herein several embodiments of wellsite systems and workflows that cool a near-wellbore zone by injection of cooling fluid for reducing hydraulic fracture initiation (breakdown) pressure. While particular embodiments of the invention have been described, it is not intended that the invention be limited thereto, as it is intended that the invention be as broad in scope as the art will allow and that the specification be read likewise. For example, a completion that employs one or more sleeves can be used in place of the perforations of the cased wellbore as described herein. In this case, the sleeve is shifted into an open position at one or more locations within the isolated wellbore interval in order to provide access to the near-wellbore zone of the reservoir and allow for injection of the cooling fluid and frac fluid into the near-wellbore zone. It will therefore be appreciated by those skilled in the art that yet other modifications could be made to the provided invention without deviating from its spirit and scope as claimed.

What is claimed is:

1. A method of fracturing a subterranean rock formation traversed by a wellbore, comprising:

injecting a cooling fluid into a near-wellbore zone to cool the near-wellbore zone and thereby reduce fracture initiation pressure;

subsequent to injecting the cooling fluid, injecting a frac fluid into the near-wellbore zone to initiate hydraulic fracture in the near-wellbore zone; and while injecting the cooling fluid into the near-wellbore zone, measuring a volume of the cooling fluid that is pumped into the wellbore and into the near-wellbore zone; and stopping the injecting of the cooling fluid into the near-wellbore zone when the measured volume matches a target volume.

2. The method according to claim 1, wherein:

the frac fluid has a higher viscosity than the cooling fluid.

3. The method according to claim 1, wherein:

the cooling fluid is selected from a group consisting of fresh water, brine, ethylene glycol, and liquefied or supercritical carbon dioxide.

4. The method according to claim 1, wherein:

the frac fluid includes a proppant suspended in the frac fluid.

5. The method according to claim 1, wherein:

the cooling fluid is injected into the near-wellbore zone using a bottomhole assembly deployed on coiled tubing in an isolated wellbore interval.

6. The method according to claim 5, wherein:

the isolated wellbore interval is isolated by a pair of isolation devices that are deployed on the coiled tubing and straddle the bottomhole assembly.

7. The method according to claim 6, wherein:

the isolation devices comprise multiset packers.

8. The method according to claim 5, wherein:

the isolated wellbore interval has a plurality of perforations that provide access to the near-wellbore zone.

9. The method according to claim 1, wherein:

the target volume is configured to induce a predefined temperature drop in the near-wellbore zone, where the near-wellbore zone extends at least three wellbore diameters beyond the wellbore and perforated zone of the formation.

10. The method according to claim 1, wherein:

the target volume is based on estimates or measurements of temperature of the cooling fluid.

11. The method according to claim 1, wherein:

the target volume is based on downhole measurements of temperature of the cooling fluid using coiled tubing telemetry.

12. The method according to claim 11, wherein:

the coiled tubing telemetry is derived from distributed temperature sensors.

13. The method according to claim 1, wherein:

the target volume is based on estimates of formation temperature of the near-wellbore zone prior to injection of the cooling fluid.

14. The method according to claim 1, wherein:

the cooling fluid is pumped through coiled tubing to an isolated wellbore interval adjacent the near-wellbore zone.

15. The method according to claim 14, further comprising:

circulating a secondary coolant through additional smaller-diameter tubing laid out inside the coiled tubing to reduce warm-up of the cooling fluid as it flows through the coiled tubing.

16. The method according to claim 14, further comprising:

deploying a downhole chiller on the coiled tubing, wherein the downhole chiller is configured to counteract warm-up of the cooling fluid as it flows through the coiled tubing.

17. The method according to claim 16, further comprising:

supplying a refrigerant to the downhole chiller by a supply line and returning refrigerant from the downhole chiller using a return line, wherein both the supply line and the return line each comprise smaller-diameter tubing laid out inside the coiled tubing.

18. The method according to claim 1, further comprising:

configuring a surface-located chiller unit to cool the cooling fluid for injection into the near-wellbore zone.

19. A system for fracturing a subterranean rock formation traversed by a wellbore, comprising:

a surface-located pump configured to pump cooling fluid through coiled tubing to an isolated wellbore interval adjacent the near-wellbore zone and inject cooling fluid into a near-wellbore zone to cool the near-wellbore zone and thereby reduce fracture initiation pressure, while injecting the cooling fluid into the near-wellbore zone, measuring a volume of the cooling fluid that is pumped into the wellbore and into the near-wellbore zone; stopping the injecting of the cooling fluid into the near-wellbore zone when the measured volume matches a target volume, wherein said pump or an additional surface-located pump is further configured to pump frac fluid through the coil tubing to the isolated wellbore interval and into the near-wellbore zone to initiate a hydraulic fracture in the near-wellbore zone.

* * * * *